US007018756B2

(12) United States Patent
Pai et al.

(10) Patent No.: US 7,018,756 B2
(45) **Date of Patent: *Mar. 28, 2006**

(54) DUAL CHARGE TRANSPORT LAYER AND PHOTOCONDUCTIVE IMAGING MEMBER INCLUDING THE SAME

(75) Inventors: Damodar M. Pai, Fairport, NY (US); Kent J. Evans, Lima, NY (US); Kathleen M. Carmichael, Williamson, NY (US); Colleen A. Helbig, Penfield, NY (US); John F. Yanus, Webster, NY (US); Yuhua Tong, Webster, NY (US); Timothy J. Fuller, Pittsford, NY (US); Karen S. Garland, Clyde, NY (US); Paul J. DeFeo, Sodus Point, NY (US); Anita P. Lynch, Webster, NY (US)

(73) Assignee: Xerox Corporation, Stamford, CT (US)

( * ) Notice: Subject to any disclaimer, the term of this patent is extended or adjusted under 35 U.S.C. 154(b) by 130 days.

This patent is subject to a terminal disclaimer.

(21) Appl. No.: 10/655,882

(22) Filed: Sep. 5, 2003

(65) Prior Publication Data

US 2005/0053854 A1 Mar. 10, 2005

(51) Int. Cl.
*G03G 5/047* (2006.01)

(52) U.S. Cl. ..... 430/58.65; 430/58.8; 430/73; 430/133

(58) Field of Classification Search ..... 430/58.65, 430/58.8, 970, 133, 73
See application file for complete search history.

(56) References Cited

U.S. PATENT DOCUMENTS

| | | | | |
|---|---|---|---|---|
| 4,032,510 | A * | 6/1977 | Floyd et al. | 524/151 |
| 4,265,990 | A | 5/1981 | Stolka et al. | 430/59 |
| 4,563,408 | A | 1/1986 | Lin et al. | 430/59 |
| 4,585,884 | A | 4/1986 | Lin et al. | 556/413 |
| 4,599,286 | A | 7/1986 | Limburg et al. | 430/59 |
| 5,308,727 | A * | 5/1994 | Osawa et al. | 430/58.05 |
| 5,401,615 | A | 3/1995 | Pai et al. | 430/59 |
| 5,906,904 | A | 5/1999 | Parikh et al. | 430/69 |
| 6,171,741 | B1 | 1/2001 | Evans et al. | 430/58.35 |
| 6,200,716 | B1 | 3/2001 | Fuller et al. | 430/64 |
| 6,214,514 | B1 | 4/2001 | Evans et al. | 430/133 |
| 6,225,014 | B1 | 5/2001 | Patterson et al. | 430/64 |
| 6,544,702 | B1 | 4/2003 | Haggquist et al. | 430/58.4 |
| 6,582,872 | B1 | 6/2003 | Willnow et al. | 430/133 |
| 6,780,554 | B1 * | 8/2004 | Tong et al. | 430/58.8 |
| 2003/0039914 | A1 | 2/2003 | Willnow et al. | 430/133 |
| 2004/0115545 | A1 * | 6/2004 | Horgan et al. | 430/58.8 |
| 2004/0126685 | A1 * | 7/2004 | Horgan et al. | 430/58.3 |
| 2004/0214100 | A1 * | 10/2004 | Yu et al. | 430/58.8 |

* cited by examiner

*Primary Examiner*—John L. Goodrow
(74) *Attorney, Agent, or Firm*—Eugene O. Palazzo; Fay, Sharpe, Fagan, Minnich & McKee, LLP

(57) ABSTRACT

A photoconductive imaging member is disclosed comprising a charge generation layer and a charge transport layer comprising an oxidative inhibitor. An electrophotographic imaging process using the imaging member of the invention is also described.

15 Claims, 1 Drawing Sheet

DUAL CHARGE TRANSPORT LAYER AND PHOTOCONDUCTIVE IMAGING MEMBER INCLUDING THE SAME

FIELD OF THE INVENTION

The present invention is directed to a dual charge transport layer comprising a top layer adjacent to a bottom layer. The top layer comprises an oxidative inhibitor. The bottom layer which is adjacent to a charge generation layer on a substrate provides a barrier for the diffusion of the oxidative inhibitor to the charge generation layer between the top layer and the charge generation layer. The invention is also directed to photoconductive imaging members comprising such charge transport layer.

BACKGROUND OF THE INVENTION

This invention relates in general to a process for fabricating a photoconductive imaging member, and more specifically to the formation of a dual charge transport layer.

In the art of electrophotography, a photoconductive imaging member containing a photoconductive layer is imaged by first uniformly electrostatically charging the imaging surface of the imaging member. The member is then exposed to a pattern of activating electromagnetic radiation such as light which selectively dissipates the charge in the illuminated areas of the photoconductive layer while leaving behind an electrostatic latent image in the non-illuminated areas. The electrostatic latent image may then be developed to form a visible image by depositing finely divided properly charged toner particles on the surface of the photoconductive layer to form a toner image which is thereafter transferred to a receiving member and fixed thereto.

A photoconductive layer for use in xerography may be a homogeneous layer of a single material such as vitreous selenium or it may be a composite of layers containing a photoconductive imaging member and another material. One type of composite photoconductive photoreceptor used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Such a photoconductive layer is often referred to as a charge generating or photogenerating layer. Generally, where the two electrically operative layers are supported on a conductive layer with the photoconductive layer capable of photogenerating holes and injecting photogenerated holes sandwiched between the contiguous charge transport layer and the supporting conductive layer, the outer surface of the charge transport layer is normally charged with uniform charges of a negative polarity and the supporting electrode is utilized as an anode. Obviously, the supporting electrode may function as a cathode when the charge transport layer is sandwiched between the electrode and a photoconductive layer which is capable of photogenerating holes and electrons and injecting the photogenerated holes into a charge transport layer when the outer surface of the photoconductive layer is charged with uniform charges of a negative polarity.

Other types of composite photoconductive imaging member employed in xerography include photoresponsive devices in which a conductive substrate or electrode is coated with optional blocking and/or adhesive layers, a charge transport layer such as a hole transport layer, and a photoconductive layer. Where the transport layer is a hole-transport layer, the outer surface of the photoconductive layer is charged negatively. These types of composite photoconductive imaging members are described in U.S. Pat. No. 4,585,884 which is incorporated herein in its entirety.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical inorganic photoconductive materials utilized in the charge generating layer include amorphous selenium, trigonal selenium, and selenium alloys such as selenium-tellurium, selenium-tellurium-arsenic, selenium-arsenic, and mixtures thereof. The organic photoconductive materials utilized in the charge generating layer include metal free phthalocyanines, vanadyl phthalocyanines, hydroxygallium phthalocyanines, substituted and unsubstituted squaraine compounds, thiopyrylium compounds and azo and diazo dyes and pigments. The charge generation layer may comprise a homogeneous photoconductive material or particulate photoconductive material dispersed in a binder. Some examples of homogeneous and binder charge generation layer are disclosed in U.S. Pat. No. 4,265,990, the disclosure of which is incorporated herein in its entirety.

Organic photoreceptors can comprise either a single layer or a multilayer structure. The commonly used multilayered or composite structure contains at least a photogeneration layer, a charge transport layer and a conductive substrate. The photogeneration layer generally contains a photoconductive pigment and a polymeric binder. The charge transport layer contains a polymeric binder and charge transport molecules (e.g., aromatic amines, hydrazone derivatives, and the like). These organic, low ionization potential charge transport molecules as well as the polymeric binders are very sensitive to oxidative conditions arising from photochemical, electrochemical and chemical reactions. In copiers, duplicators and electronic printers, such charge transport molecules are frequently exposed to deleterious environmental conditions induced by light, charging devices (such as corotrons, dicorotrons, scorotrons and the like), electric fields, oxygen, oxidants and moisture. Undesirable chemical species are often formed during fabrication or during use in imaging processes which may react with key organic components in the charge transport layer or photogeneration layer of the photoreceptors. These unwanted chemical reactions can cause photoreceptor degradation, poor charge acceptance and cyclic instability.

Several types of reactive chemical species that are likely to be formed in the operational environment of a copier or an electronic printer include: (a) oxidants (e.g. peroxides, hydroperoxides, ozone, nitrous oxides, and the like); (b) both organic and inorganic radicals and diradicals (e.g. R.; $RO_2$.; $NO_2$.; OH.; and the like.); (c) ionic species having positive (e.g. aromatic amine) or negative charges; and (d) both singlet oxygen states can form through a sensitized photooxidation mechanism.

The foregoing chemical species can be generated from chemical, electrochemical and photochemical reactions as well as from the corona discharge in air by a charging device. The oxidative intermediates and their products usually degrade the surface of the photoreceptor and lead to various problems. If the surface of the photoreceptor degrades as a result of chemical and photochemical reactions, the photoreceptor surface becomes conductive (e.g. electrical charges develop and can laterally migrate) and exhibits image quality degradation Depending on the degree of damage, the photoreceptor degradation can lead to poor image quality, or even an inability of a copier or an electronic printer to produce a print.

Photosensitive members having at least two electrically operative layers are disclosed in, for example, U.S. Pat. No. 4,265,990 and U.S. Pat. No. 4,585,884 and provide excellent images when charged with a uniform electrostatic charge, exposed to a light image and thereafter developed with finely divided toner particles. However, when the charge transport layer comprises a film forming resin and one or more of certain aromatic amines, diamines and hydrazone compounds, difficulties have been encountered with these photosensitive members when they are used under certain conditions in copiers, duplicators and printers.

When photosensitive members having at least two electrically operative layers with the charge transport layer comprising an antioxidant, migration of the antioxidant in the charge generation layer can result and contributes to a significant increase in the residual voltages due to the acidic nature of the antioxidant.

Photosensitive members having a charge transport dual layer have been disclosed in U.S. Pat. No. 5,830,614 which is incorporated herein by reference in its entirety. The dual charge transport layer includes a first transport layer containing a charge-transport polymer and a second transport layer containing a charge-transport polymer having a lower weight percent of charge transporting segments than the charge-transporting polymer in the first transport layer. The resulting imaging member has greater resistance to corona effects and provides for a longer service life.

Photosensitive members having more than one charge transport layer have been disclosed in U.S. Pat. No. 6,214,514 which is incorporated herein by reference in its entirety. By using more than one charge transport layer sequentially applied, coating uniformity is achieved, raindrop effects are eliminated and curl is reduced.

While the above mentioned imaging members may be suitable for their intended purposes, there continues to be a need for improved imaging members which impart greater stability to electrophotographic imaging systems, thus improving xerographic performance (e.g. cyclic stability and charge uniformity) and the life of the photoconductive imaging member.

SUMMARY OF THE INVENTION

It is, therefore, an object of the present invention to provide an improved process for fabricating a photoconductive imaging member.

It is another object of the present invention to provide for an improved process for achieving greater stability of the electrographic imaging systems.

The foregoing objects and others are accomplished in accordance with this invention by providing a process for fabricating a charge transport layer having a top layer and a bottom layer adjacent to each other. The top layer comprises a binder and hole transporting small molecule with an added oxidative inhibitor. The bottom layer which is deposited on the charge generation layer provides a barrier for the diffusion of the oxidative inhibitor to the charge generation layer.

A process is provided for fabricating an imaging member comprising the charge transport layer of the invention deposited on a charge generating layer. The charge generation layer is deposited on a substrate. The imaging member also includes a back coating layer on the backside of the substrate, a conductive layer, a blocking layer and a ground strip layer.

The imaging member prepared according to the present invention may be employed in any suitable and conventional electrophotographic imaging process which utilizes uniform charging prior to image wise exposure to activating electromagnetic radiation. Due to the inclusion of an oxidative inhibitor in the top layer of the charge transport layer, the imaging member of the invention exhibits improved xerographic performance (e.g. cyclic stability and charge uniformity) and a lengthening of the life of the photoconductive imaging member.

These objects and the advantages of the invention will be more readily apparent in view of the following detailed description.

BRIEF DESCRIPTION OF THE FIGURE

A more complete understanding of the process of the present invention can be obtained by reference to the accompanying drawing wherein.

Figure 1:
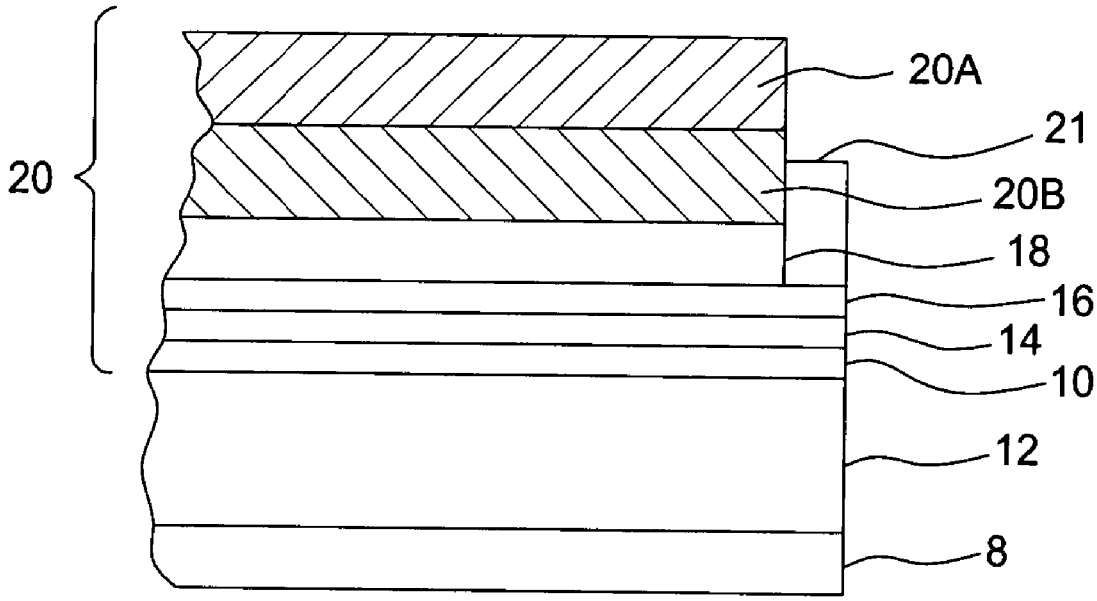
FIG. 1 is a cross-sectional view of the imaging member of the invention.

This FIGURE is referred to in greater detail in the following detailed description.

DETAILED DESCRIPTION OF THE PREFERRED EMBODIMENTS

A representative structure of a photoconductive imaging member of the invention is shown in FIG. 1. This imaging member is provided with a back coating layer (8), a substrate (12), a conductive layer (10), a blocking layer (14), an adhesive layer (16), a charge generation layer (18), a charge transport layer (20) comprising a top layer (20*a*) and a bottom layer (20*b*) and a ground strip layer (21).

The Back Coating Layer

A back coating layer (8) can be formed on the back side of substrate (12). The back coating layer may include film-forming organic or inorganic polymers that are electrically insulating or slightly semi-conductive. The back coating layer provides flatness and/or abrasion resistance.

The back coating layer may include, in addition to the film-forming resin, an adhesion promoter polyester additive. Examples of film-forming resins useful in the back coating layer include, but are not limited to, polyacrylate, polystyrene, poly(4,4'-isopropylidene diphenylcarbonate), poly(4,4'-cyclohexylidene diphenylcarbonate), mixtures thereof and the like.

Additives may be present in the back coating layer in the range of about 0.5 to about 40 weight percent of the back coating layer. Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Another semiconducting additive is the oxidized oligomer salts as described in U.S. Pat. No. 5,853,906. The preferred oligomer salts are oxidized N,N, N',N'-tetra-p-tolyl-4,4'-biphenyldiamine salt.

Typical adhesion promoters useful as additives include, but are not limited to, duPont 49,000 (duPont), Vitel PE-100, Vitel PE-200, Vitel PE-307 (Goodyear), mixtures thereof and the like. Usually from about 1 to about 15 weight percent adhesion promoter is selected for film-forming resin addition, based on the weight of the film-forming resin.

The thickness of the back coating layer is from about 3 micrometers to about 35 micrometers, preferably from about 14 micrometers to about 18 micrometers. However, thicknesses outside these ranges can be used.

The back coating layer can be applied as a solution prepared by dissolving the film-forming resin and the adhesion promoter in a solvent such as methylene chloride. The solution may be applied to the rear surface of the substrate (the side opposite the imaging layers) of the photoreceptor device, for example, by web coating or by other methods known in the art.

The Substrate

As indicated above, the imaging member is prepared by first providing a substrate (12), which functions as a support. The substrate can comprise a layer of electrically non-conductive material or a layer of electrically conductive material, such as an inorganic or organic composition. If a non-conductive material is employed, it is necessary to provide an electrically conductive layer over such non-conductive material. If a conductive material is used as the substrate, a separate conductive may not be necessary.

The substrate can be flexible or rigid and can have any of a number of different configurations, such as, for example, a sheet, a scroll, an endless flexible belt, a web, a cylinder, and the like. The photoreceptor may be coated on a rigid, opaque, conducting substrate, such as an aluminum drum.

Various resins can be used as electrically non-conducting materials, including, but not limited to, polyesters, polycarbonates, polyamides, polyurethanes, and the like. Such a substrate preferably comprises a commercially available biaxially oriented polyester known as MYLAR™ (E. I. duPont de Nemours & Co.), MELINEX™ (duPont-Teijin Film), KALEDEX™ 2000 (ICI Americas Inc.), Teonex™ (ICI Americas Inc.), or HOSTAPHAN™ (American Hoechst Corporation). Other materials of which the substrate may be comprised include polymeric materials, such as polyvinyl fluoride, available as TEDLAR™ (E. I. duPont de Nemours & Co.), polyethylene and polypropylene, available as MARLEX™ (Phillips Petroleum Company), polyphenylene sulfide, RYTON™(TM) (Phillips Petroleum Company), and polyimides, available as KAPTON™ (E. I. duPont de Nemours & Co). The photoreceptor can also be coated on an insulating plastic drum, provided a back coating layer has previously been coated on its backside. Such substrates can either be seamed or seamless.

When a conductive substrate is employed, any suitable conductive material can be used. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers such as polyacetylene or its pyrolysis and molecular doped products, charge transfer complexes, and polyphenyl silane and molecular doped products from polyphenyl silane. A conducting plastic drum can be used, as well as the preferred conducting metal drum made from a material such as aluminum.

The thickness of the substrate depends on numerous factors, including the required mechanical performance and economic considerations. The thickness of substrate may range between about 50 micrometers and about 150 micrometers. The substrate is selected such that it is not soluble in any of the solvents or reagents used in each coating layer solution. The substrate is selected from material such that it is optically clear and thermally stable as determined by the application and is selected to withstand a temperature of no less than about 150° C.

The surface of the substrate to which a layer is to be applied is preferably cleaned to promote greater adhesion of such a layer. Cleaning can be effected, for example, by exposing the surface of the substrate layer to plasma discharge, ion bombardment, and the like. Other methods, such as solvent cleaning, can be used.

Regardless of any technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

The Conductive Layer

As stated above, the imaging member of the invention comprises a substrate which is either electrically conductive or electrically non-conductive. When an electrically non-conductive substrate is employed, an electrically conductive layer (10) is employed. When a conductive substrate is used, the substrate acts as the conductive layer, although a conductive layer may also be provided.

If an electrically conductive layer is used, it is positioned over the substrate. Suitable materials for the electrically conductive layer include, but are not limited to, aluminum, zirconium, niobium, tantalum, vanadium, hafnium, titanium, nickel, stainless steel, chromium, tungsten, molybdenum, copper, and the like, and mixtures and alloys thereof. In other embodiments, aluminum, titanium, and zirconium are preferred. If a non-electrically conductive layer is used, various resin materials may be used including but not limited to, polyesters, polycarbonates, polyamides, polyurethanes, and the like.

The conductive layer can be applied by known coating techniques, such as solution coating, vapor deposition, and sputtering. A preferred method of applying an electrically conductive layer is by vacuum deposition. Other suitable methods can also be used.

Preferred thicknesses of the conductive layer are within a substantially wide range, depending on the optical transparency and flexibility desired for the imaging member. Accordingly, for a flexible imaging member, the thickness of the conductive layer is preferably between about 20 angstroms and about 750 angstroms; more preferably, from about 50 angstroms to about 200 angstroms for an optimum combination of electrical conductivity, flexibility, and light transmission. However, the conductive layer can, if desired, be opaque.

The Blocking Layer

After deposition of any electrically conductive layer ground plane layer, a charge blocking layer (14) can be applied thereon. Electron blocking layers for positively charged photoreceptors permit holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer can be utilized.

If a blocking layer is employed, it is preferably positioned over the electrically conductive layer. The term "over," as used herein in connection with many different types of layers, should be understood as not being limited to instances wherein the layers are contiguous. Rather, the term refers to relative placement of the layers and encompasses the inclusion of unspecified intermediate layers.

The blocking layer may be formed from any material and may comprise nitrogen containing siloxanes or nitrogen containing titanium compounds. Materials disclosed in U.S. Pat. Nos. 4,291,110, 4,338,387, 4,286,033 and 4,291,110 which are incorporated herein by reference in their entirety can be used.

The blocking layer can be applied by any suitable technique, such as spraying, dip coating, draw bar coating, gravure coating, extrusion coating, silk screening, air knife coating, reverse roll coating, vacuum deposition, chemical treatment, and the like. For convenience in obtaining thin layers, the blocking layer is preferably applied in the form of a dilute solution, with the solvent being removed after deposition of the coating by conventional techniques, such as by vacuum, heating, and the like. Generally, a weight ratio of blocking layer material and solvent of between about 0.1:100 to about 5.0:100 is satisfactory for extrusion coating.

The Adhesive Layer

An adhesive layer (16) may be applied to the blocking layer. Any material to form the adhesive layer may be utilized and is selected to impart the desired final characteristics to the adhesive layer. The adhesive layer should preferably be continuous with a dry thickness between from about 0.1 microns to about 0.9 microns and, preferably, between from about 0.2 microns and to about 0.7 microns. Adhesive layer (16) comprising a linear saturated copolyester reaction product of four diacids and ethylene glycol, consisting of alternating monomer units of ethylene glycol and four randomly sequenced diacids with a weight average molecular weight of about 70,000 and a Tg of about 32° C. Alternatively a linear saturated product consisting of monomer units of bis Phenol-A, isophthalic acid and terephthalic acid in a ratio of 2:1:1 with a weight average molecular weight of about 51,000 and a Tg of about 190° C. may also be used. The adhesive layer may also comprise a copolyester resin, and any suitable solvent or solvent mixtures may be employed to form a coating solution of the polyester. Example of solvents include tetrahydrofuran, toluene, methylene chloride, cyclohexanone, and the like, and mixtures thereof.

Any suitable techniques of application may be utilized to mix and thereafter apply the adhesive layer as a coating mixture on the charge blocking layer. Application techniques include spraying, dip coating, roll coating, wire wound rod coating, and the like. Drying of the adhesive layer may be effected by any suitable conventional technique such as oven drying, infra red radiation drying, air drying and the like.

The Charge Generation Layer

In fabricating a photosensitive imaging member of the invention, a charge generation layer (18) and a charge transport layer (20) may be deposited onto the substrate surface in a laminate type configuration where the charge generation layer and the charge transport layer are in different layers.

The charge generation layer may be applied to the blocking layer or to the adhesive layer if an adhesive layer is utilized. The charge generation layer may be formed from any photogenerating materials dispersed in a film forming binder. Such photogenerating material can be selected from inorganic photoconductive materials such as for example, amorphous selenium, trigonal selenium, and selenium alloys selected from the group consisting of selenium-tellurium, selenium-tellurium-arsenic, selenium arsenide and mixtures thereof. Such photogenerating material can also be selected from organic photoconductive materials such as for example, phthalocyanine pigments (such as the X-form of metal free phthalocyanine), metal phthalocyanines (such as vanadyl phthalocyanine, hydroxygallium phthalocyanine, and copper phthalocyanine), quinacridones, dibromo anthanthrone pigments, benzimidazole perylene, substituted 2,4-diamino-triazines, polynuclear aromatic quinones, and the like. A mixture of different compositions may be selected to enable the control of the properties of the charge generation layer.

The charge generation layer comprising photoconductive particles dispersed in a film forming binder may be utilized. A range of photoconductive material can be used based on their sensitivity to white light or their sensitivity to infrared light and should be sensitive to an activating radiation with wavelength between about 600 and about 700 nm. Photoconductive material can be selected from vanadyl phthalocyanine, hydroxygallium phthalocyanine, metal free phthalocyanine, tellurium alloys, benzimidazole perylene, amorphous selenium, trigonal selenium, selenium alloys such as selenium-tellurium, selenium-tellurium-arsenic, selenium arsenide, and the like and mixtures. Vanadyl phthalocyanine, metal free phthalocyanine, hydroxygallium phthalocyanine and tellurium alloys are preferred because they are sensitive both to white light and infrared light.

Any suitable inactive resin materials can be used as a binder in the charge generation layer. For example, binders described in U.S. Pat. No. 3,121,006, which is incorporated herein by reference in its entirety can be used. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly (amideimide), styrene-butadiene copolymers, vinylidenechloridevinylchloride copolymers, vinylacetate-vinylidenechloride copolymers, styrene-alkyd resins, and the like.

A pigment or photogenerating composition can be used in the resin binder of the charge generation layer in various amounts. Generally, from about 5 percent by volume to about 90 percent by volume of the pigment can be dispersed in about 10 percent by volume to about 95 percent by volume of the binder resin, and preferably from about 30 percent by volume to about 50 percent by volume of the pigment can be dispersed in about 50 percent by volume to about 70 percent by volume of the binder resin.

The thickness of the charge generation layer is from about 0.1 micrometer to about 5 micrometers, and preferably from about 0.3 micrometer to about 3 micrometers. The thickness of the charge generation layer is related to the binder content. Higher binder content compositions generally require that the charge generation layer has a thicker layer.

The Charge Transport Layer

The charge transport layer (20) may comprise any suitable transparent organic polymeric or non-polymeric material capable of supporting the injection of photogenerated holes from the charge generation layer and allowing the transport of these holes to selectively discharge the surface charge. It is important that holes are not trapped inside the charge transport layer, otherwise the surface charges will not be totally discharged and the image will not be completely developed. The charge transport layer not only serves to transport holes, but also protects the charge generation layer from abrasion or chemical attack and by doing so, extends the operating life of the imaging member. The charge transport layer should exhibit negligible, if any, discharge when exposed to a wavelength of light useful in xerography (such wavelength range between 4000 angstroms to 9000 angstroms). Therefore, the charge transport layer is substantially transparent to radiation in a region in which the imaging member will be utilized. Thus, the composition of the charge transport layer is essentially non-photoconductive to support the injection of photogenerated holes from the charge generation layer. The charge transport layer is normally transparent when exposure is effectuated through the charge generation layer to ensure that most of the incident radiation is utilized by the charge generation layer for efficient photogeneration. The charge transport layer in conjunction with the charge generation layer functions as an insulator to the extent that an electrostatic charge placed on the charge transport layer is not conducted in the absence of illumination.

The charge transport layer may comprise any suitable activating compound useful as an additive dispersed in electrically inactive polymeric materials making these materials electrically active. These compounds may be added to polymeric materials which are incapable of supporting the injection of photogenerated holes from the charge generation material and incapable of allowing the transport of these holes there through. This will convert the electrically inactive polymeric material to a material capable of supporting the injection of photogenerated holes from the charge generation material and capable of allowing the transport of these holes through the charge generation layer in order to discharge the surface charge on the charge generation layer.

Any suitable coating techniques may be employed to form the charge transport layer coatings. Typical techniques include spraying, extrusion die coating, roll coating, wire wound rod coating, and the like. The methods set forth in U.S. Pat. No. 6,214,514 can be used to deposit sequentially the bottom layer on the charge generating layer and to deposit the top layer on the bottom layer. Drying of the deposited coating may be effected by any suitable conventional technique such as oven drying, infra red radiation drying, air drying and the like. Generally, the combined thickness of the top layer (20*a*) and the bottom layer (20*b*) is between about 15 micrometers and about 40 micrometers, and more preferably between about 24 micrometers to about 30 micrometers for optimum photo-electrical and mechanical results. The thickness ratio of top layer (20*a*) to bottom layer (20*b*) ranges from about 1:10 to about 1:1, preferably the thickness ratio of layer (20*a*) to layer (20*b*) is from about 1:4 to about 1:1. The ratio of the thickness of the charge transport layer to the charge generation layer is preferably maintained from about 50:1 to about 100:1.

Both top and bottom layers of the charge transport layer comprise a charge transport compound and a binder. In addition, the top layer comprises an oxidative inhibitor. The top and bottom layers are adjacent to each other with the bottom layer providing a barrier for diffusion of the oxidative inhibitor between the top layer and the charge generation layer.

The top and bottom layers of the charge transport layer are generally formed from a solid solution comprising a charge transport compound dissolved in an inactive resin binder. Such resin binder includes polycarbonate resin, polyester, polyarylate, polyacrylate, polyether, polysulfone, and the like. Molecular weights can vary, for example, from about 20,000 to about 150,000. Examples of binders include polycarbonates such as poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge transporting polymer may also be used in the charge transporting layer of this invention. For achieving optimum photo-electrical and dynamic mechanical imaging member belt machine functions, the charge transport layer is typically a binary mixture comprising on a weight percent ratio of charge transport compound to polymer binder of from about 35:65 to 60:40, preferably about 50:50

Any suitable charge transporting or electrically active small molecule may be employed in the top and bottom layers of the charge transport layer of this invention. The expression charge transporting "small molecule" is defined herein as a compound that allows the free charge photogenerated in the charge transport layer to be transported across the charge transport layer. The charge transport compound present in the top layer and bottom layer of the charge transport layer may either be the same or a different charge transport compound, provided that the oxidative inhibitor is only present in the top layer in order to reduce surface conductivity caused by corona species.

Pyrazolines as described in U.S. Pat. Nos. 4,315,982, 4,278,746, 3,837,851, and 6,214,514 can be used as charge transport compounds. Typical pyrazoline charge transport compounds include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl) pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Diamines as described in U.S. Pat. Nos. 4,306,008, 4,304,829, 4,233,384, 4,115,116, 4,299,897, 4,265,990, 4,081,274 and 6,214,514 can be used as charge transport compounds. Typical diamine transport compounds include N,N'-diphenyl-N,N'-bis(alkylphenyl)-[1,1'-biphenyl]-4,4'-diamine wherein the alkyl is linear such as for example, methyl, ethyl, propyl, n-butyl and the like, N,N'-diphenyl-N,N'-bis(3-methylphenyl)-[1,1'-biphenyl]-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N,N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. Nos. 4,315,982, 4,278,746, 3,837,851 and 6,124,514 can be used as charge transport compounds. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-( 2)]-3-(p-diethylaminostyryl)-5-(p-diethylaminophenyl) pyrazoline, 1-phenyl-3-[p-dimethylaminostyryl]-5-(p-dimethylaminostyryl) pyrazoline, 1-phenyl-3-[p-diethylaminostyryl]-5-(p-diethylaminostyryl)pyrazoline, and the like.

Substituted fluorene charge transport molecules as described in U.S. Pat. Nos. 4,245,021 and 6,214,514 can be used as charge transport compounds. Typical fluorene charge transport molecules include 9-(4'-dimethylaminobenzylidene)fluorene, 9-(4'-methoxybenzylidene)fluorene, 9-(2'4'-dimethoxybenzylidene)fluorene, 2-nitro-9-benzylidene-fluorene, 2-nitro-9-(4'-diethylaminobenzylidene) fluorene and the like.

Oxadiazole transport molecules can be used as charge transport compounds and include 2,5-bis(4-diethylaminophenyl)-1,3,4-oxadiazole, pyrazoline, imidazole, triazole, and others described in German Pat. Nos. 1,058,836, 1,060,260 and 1,120,875 and U.S. Pat. No. 3,895,944.

Hydrazone described, for example in U.S. Pat. Nos. 4,150,987 and 6,124,514 can be used as charge transport compounds and include, for example, p-diethylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), dimethylaminobenzaldehyde-(diphenylhydrazone) and the like. Other hydrazone transport molecules include compounds such as 1,1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone. Other hydrazone transport molecules described, for example in U.S. Pat. Nos. 4,385,106, 4,338,388, 4,387,147, 4,399,208, 4,399,207 can also be used.

Still another charge transport molecule is a carbazole phenyl hydrazone. Typical examples of carbazole phenyl hydrazone transport molecules include 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426.

Tri-substituted methanes can also be used as charge transport compounds and include alkyl-bis(N,N-dialkylaminoaryl)methane, cycloalkyl-bis(N,N-dialkylaminoaryl) methane, and cycloalkenyl-bis(N,N-dialkylaminoaryl)methane as described, for example, in U.S. Pat. No. 3,820,989.

A preferred charge transport compound is an aromatic amine represented by the following molecular formula:

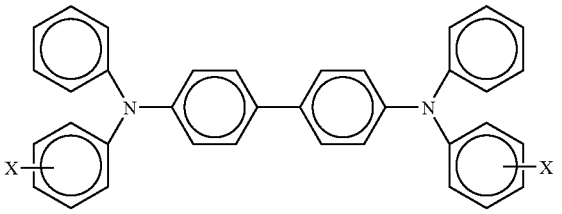

wherein X is a linear or branched alkyl having from one to 12 carbon atoms, preferably from one to 6 carbon atoms. The alkyl group is preferably a methyl group in the meta or para position. When an aryl amine such as N,N'-diphenyl-N,N'-bis(3-methylphenyl)-[1,1'-biphenyl]-4,4'diamine is used in the top and bottom layers of the charge transporting layer, the concentration of the amine in the top layer is preferred to be less than in the bottom layer in order to achieve robust functionality.

The charge transport layer forming solution preferably comprises an aromatic amine compound as the activating compound. An especially preferred charge transport layer composition employed to fabricate the top layer and bottom layer of the charge transport layer comprises from about 35 percent to about 65 percent by weight of at least one charge transporting aromatic amine compound, and about 65 percent to about 35 percent by weight of a polymeric film forming resin in which the aromatic amine is soluble, and the like.

The aromatic amine concentration in the bottom layer is between about 40 and about 70 weight percent, but preferably to about 50 weight percent based from the total weight of the bottom layer. Therefore, the concentration of the amine in the top layer is from about 20 to about 45 weight percent based on the total weight of the top layer, but with a preferred concentration of from about 43 to about 35 weight percent to achieve optimum performance as well as charge transport layer cracking suppression Several classes of antioxidants can be used as oxidative inhibitors and can be incorporated in the top layer of the charge transport layer. These antioxidants have the ability to deactivate a range of species such as free radicals, oxidizing agents and singlet oxygen and have the ability to hinder the formation of undesired conductive species on the imaging member under the influence of charging devices. When incorporated into the top layer of the charge transport layer of the invention, these oxidative inhibitors have been found to improve xerographic performance (e.g. cyclic stability and charge uniformity) and the life of the photoconductive imaging member. Since antioxidants can have an adverse effect on the electrical properties of the charge generation layer and thus can have an adverse effect on the overall functionality of the photoconductive imaging member, the oxidative inhibitors of the invention are added to the top layer (20*a*) of the charge transport layer which does not come into contact with the charge generation layer. By having the bottom layer as an intermediate layer between the top layer and the charge generation layer, the diffusion of the oxidative inhibitors into the charge generation layer is minimized. Thus, a resultant benefit is that the electrical properties of the charge generation layer are not affected and the overall functionality of the photoconductive imaging member is maintained.

The oxidative inhibitors of the invention may be substituted, unsubstituted, monomeric or polymeric compounds and are selected on the basis that they are able to perform multiple oxidative functions. U.S. Pat. No. 4,563,408 (Lin et al) discloses antioxidants (free radical inhibitors or quenchers or stabilizers) which can prevent or retard the autooxidation of organic material including aromatic diamine charge transport molecules, aromatic amine derivatives and hydrazone compounds. U.S. Pat. No. 4,888,262 (Tamaki et al) discloses ester-containing antioxidizing agents comprising hindered phenolics and organic sulfur compounds. U.S. Pat. No. 4,943,501 (Kinoshita et al) discloses antioxidants compounds comprising hindered phenol structure units. The antioxidants disclosed in the Lin, Tamaki and Kinoshita patents can be used in the charge transport layer of the invention, and the Lin, Tamaki and Kinoshita patents are incorporated herein by reference in their entirety. Hindered phenols are the preferred oxidative inhibitors, because of their compatibility with a range of polymers. They also help minimize thermal degradation, are colorless, possess low volatility, have low toxicity and are inexpensive. Hindered phenols are intended to include ring substituted hydroxybenzenes, and more specifically pentaerythritol tetrakis[3,5-di-tert-butyl-4-hydroxyhydrocinnamate] (also known as erythrityl tetrakis(beta-[4-hydroxy-3,5-di-tert-butylphenylpropionate])), butylated hydroxytoluene or mixture thereof. The properties of hindered phenols such as their antioxidative efficiency for inhibiting free radicals and singlet oxygen reactions, and their lack of toxicity make suitable as antioxidants of the invention.

The oxidative inhibitor of interest may be added to known photoconductive fabrication formulations. These formulations generally consist of solid solutions of polycarbonates and a hole transport small molecule. The resulting formulation should be soluble in the binder matrix in the coating solvent and be dispersible in the binder matrix. It is desirable that the oxidative inhibitor also be soluble in the charge transport layer.

Satisfactory results may be achieved when the charge transport layer contains from about 1 percent by weight to about 20 percent by weight of the antioxidant based on the total weight of the charge transport layer. Preferably, the charge transport layer contains from about 3 percent by weight to about 15 percent by weight of the antioxidant based on the total weight of the charge transport layer. Optimum results are achieved with about 5 percent by weight to about 10 percent by weight of the antioxidant. Since the effect of the antioxidant depends to some extent on the particular photoconductive imaging member treated and the specific antioxidant employed, the optimum concentration of the antioxidant can be determined experimentally.

The Ground Strip Layer

The ground strip layer (21) comprising, for example, conductive particles dispersed in a film forming binder may be applied to one edge of the photoreceptor in contact with the conductive layer, the blocking layer, the adhesive layer or the charge generation layer. The ground strip may comprise any suitable film forming polymer binder and electrically conductive particles. Typical ground strip materials include those described in U.S. Pat. No. 4,664,995. The ground strip layer may have a thickness from about 7 micrometers to about 42 micrometers, and preferably from about 14 micrometers to about 23 micrometers.

Photoconductive imaging members containing the oxidative inhibitors of this invention may be exposed to any imaging light source including U.V., visible and near infrared light. The imaging member of the present invention is particularly useful primarily in infrared imaging device wherein light emitted by solid state lasers are utilized. Such a device has sensitivity ranging from about 700 nanometers to about 950 nanometers, and thus can be selected for use with solid state lasers, including gallium aluminum arsenide lasers and gallium arsenide lasers. The imaging members of the present invention are also sensitive to visible light having a wavelength of from about 400 nanometers to about 700 nanometers.

The antioxidants of the invention minimize the conductive species present on the surface of the photoreceptor. Prints from the photoreceptors containing antioxidants are sharp and without any fuzziness. It is believed that the antioxidants of the invention function by two mechanisms. Firstly, the antioxidants prevent the formation of charge transport layer adducts by interacting with the charging device effluents as sacrificial reactants on the photoreceptor surface. Secondly, the antioxidants terminate the catalytic polymer decomposition and deactivate the reacted charge transport small molecule radical cations by quenching the formed adducts.

The photoconductive imaging members containing the antioxidants of this invention exhibit better surface properties due to the disposition of the corona effluents which are highly acidic and reactive species and reside on the photoreceptor surface. These species react with the charge transfer molecules on the photoreceptor surface, causing the formation of free radicals leading to surface conductivity and subsequent image deterioration and allow charge patterns to diffuse, yielding out of focus prints. These species also initiate catalytic decomposition of the polycarbonate moieties which leads to the premature deterioration of mechanical properties causing undesirable cracking and crazing of the charge transport layer. All the foregoing deleterious effects are eliminated with the photoconductive imaging members of the invention.

A number of examples are set forth herein below and are illustrative of different compositions and conditions that can be utilized in practicing the invention. All proportions are by weight unless otherwise indicated. It will be apparent, however, that the invention can be practiced with many types of compositions and processes and can have many different uses in accordance with the disclosure above and as pointed out hereinafter.

EXAMPLE 1

An imaging member was prepared by providing a 0.02 micrometer thick titanium layer coated on a biaxially oriented polyethylene naphthalate substrate (KALEDEX™ 2000) having a thickness of 3.5 mils, and applying thereon, with a gravure applicator, a solution containing 50 grams 3-amino-propyltriethoxysilane, 41.2 grams water, 15 grams acetic acid, 684.8 grams of 200 proof denatured alcohol and 200 grams heptane. This layer was then dried for about 5 minutes at 135° C. in the forced air drier of the coater. The resulting blocking layer (14) had a dry thickness of 500 Angstroms.

An adhesive layer (16) was then prepared by applying a wet coating over the blocking layer, using a gravure applicator, containing 0.2 percent by weight based on the total weight of the solution of copolyester adhesive (Ardel D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion is prepared by introducing 0.45 grams of lupilon200(PC-Z 200) available from Mitsubishi Gas Chemical Corp and 50 ml of tetrahydrofuran into a 4 oz. glass bottle. To this solution are added 2.4 grams of hydroxygallium phthalocyanine and 300 grams of ⅛ inch (3.2 millimeter) diameter stainless steel shot. This mixture is then placed on a ball mill for 20 to 24 hours. Subsequently, 2.25 grams of PC-Z 200 is dissolved in 46.1 gm of tetrahydrofuran, and added to this OHGaPc slurry. This slurry is then placed on a shaker for 10 minutes. The resulting slurry was, thereafter, applied to the adhesive interface with a Bird applicator to form a charge generation layer (18) having a wet thickness of 0.25 mil. However, a strip about 10 mm wide along one edge of the substrate web bearing the blocking layer and the adhesive layer was deliberately left uncoated by any of the photogenerating layer material to facilitate adequate electrical contact by the ground strip layer that was applied later. The charge generation layer was dried at 135° C. for 5 minutes in a forced air oven to form a dry charge generation layer having a thickness of 0.4 micrometer.

This imaging member web was simultaneously overcoated with a charge transport layer (20) and a ground strip layer (21) using extrusion co-coating process. This charge generation layer was overcoated with a charge transport layer, with the bottom layer (20*b*) in contact with the charge generation layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon 5705®, a polycarbonate resin having a molecular weight of from about 50,000 to 100,000 commercially available from Farbenfabriken Bayer A.G. The resulting mixture was dissolved in methylene chloride to form a solution containing 15 percent by weight solids. This solution was applied on the charge generation layer to form a coating of the bottom layer which upon drying had a thickness of 14.5 microns. During this coating process the humidity was equal to or less than 15 percent.

The bottom layer of the charge transport layer was overcoated with a top layer (20*a*). The charge transport layer solution of the top layer was prepared as described above for the bottom layer. This solution was applied on the bottom layer of the charge transport layer to form a coating which upon drying had a thickness of 14.5 microns. During this coating process the humidity was equal to or less than 15 percent. The imaging member resulting from the application of all layers as described above was annealed at 135° C. in a forced air oven for 5 minutes and thereafter cooled to ambient room temperature.

The approximately 10 mm wide strip of the adhesive layer (16) left uncoated by the charge generation layer was coated over with a ground strip layer (21) during the coating process. This ground strip layer, after drying along with the coated top and bottom layers of the charge transport layer at 135° C. in the forced air oven for minutes, had a dried thickness of about 19 micrometers. This ground strip layer is electrically grounded, by conventional means such as a carbon brush contact means during conventional xerographic imaging process.

A back coating layer (8) was prepared by combining 8.82 grams of polycarbonate resin (Makrolon 5705®, available from Bayer AG), 0.72 gram of polyester resin (Vitel PE-200® available from Goodyear Tire and Rubber Company) and 90.1 grams of methylene chloride in a glass container to form a coating solution containing 8.9 percent solids. The container was covered tightly and placed on a roll mill for about 24 hours until the polycarbonate and polyester were dissolved in the methylene chloride to form the back coating solution. The back coating solution was applied to the back side of the substrate, again by extrusion coating process, and dried at 135° C. for about 5 minutes in the forced air oven to produce a dried film thickness of about 17 micrometers. The resulting imaging member had a structure similar to the one shown in FIG. 1.

EXAMPLE 2

An imaging member was prepared as in Example 1 except each of the top and bottom layers of the charge transport layer contained 6.8% Irganox 1010® by weight of the dry solids. The weight ratio of 1:1 N,N'-diphenyl-N,N'-bis(3-methylphenyl)-1,1'-biphenyl-4,4'-diamine and Makrolon 5705® remained the same.

EXAMPLE 3

An imaging member was prepared as in Example 1 except the top layer of the charge transport layer contained 6.8% Irganox I-1010® by weight of the dry solids. The weight ratio of 1:1 N,N'-diphenyl-N,N'-bis(3-methylphenyl)-1,1'-biphenyl-4,4'-diamine and Makrolon 5705® remained the same.

EXAMPLE 4

The imaging members prepared according to Examples 1, 2 and 3 may be machine coated. In this Example, samples of imaging members which were machine coated were tested for their xerographic properties by evaluating them with a xerographic testing scanner comprising a cylindrical aluminum drum having a diameter of 24.26 cm (9.55 inches). The test samples were taped onto the drum. When rotated, the drum carrying the samples produced a constant surface speed of 76.3 cm (30 inches) per second. A direct current pin corotron, exposure light, erase light, and five electrometer probes were mounted around the periphery of the mounted photoreceptor samples. The sample charging time was 33 milliseconds. The expose light had a 780 nm output and erase light was broad band white light (400–700 nm) output, each supplied by a 300 watt output Xenon arc lamp. The test samples were first rested in the dark for at least 60 minutes to ensure achievement of equilibrium with the testing conditions at 40 percent relative humidity and 21° C. Each sample was then negatively charged in the dark to a development potential of about 900 volts. The charge acceptance of each sample and its residual potential after discharge by front erase exposure to 400 ergs/cm2 were recorded. Dark Decay was measured as a loss of Vddp after 1.09 seconds. The test procedure was repeated to determine the photo induced discharge characteristic (PIDC) of each sample by different light energies of up to 20 ergs/cm2. The photodischarge is given as the ergs/cm2 needed to discharge the photoreceptor from a Vddp 800 volts to 100 volts (E800-100). The test was repeated for 10,000 cycles and the % change from cycle 1 to cycle 10,000 for residual potential, photodischarge, and dark decay was recorded. Samples of the imaging members prepared according to Examples 1, 2 and 3 were tested for surface conductivity due to oxidizing species by exposing to corotron discharge and then print testing for poor image quality due to surface degradation.

As shown by the machine coated samples of the imaging members prepared in accordance with Examples 1 and 2, the addition of antioxidant to the top and bottom layers of the charge transport layer gives unacceptable rise in residual voltage, and an increase in exposure necessary for photodischarge to a given voltage and a rise in dark decay over the 10,000 cycles indicating less cyclic stability. Print image quality improved. Samples of the machine coated sample of the imaging member prepared in accordance with Example 3 with the antioxidant in the top layer of the charge transport layer gives equivalent protection from oxidation as machine coated sample prepared in accordance with Example 2 and brings the xerographic properties closer to desired levels.

EXAMPLE 5

Machine coated samples of the imaging members prepared in accordance with Examples 1, 2 and 3 were cut into small rectangles (1.5 inches×8 inches) and were wrapped around a photoreceptor cylindrical drum. All samples were exposed to corona effluence produced from a couple of corotron wires operating at 700–800V and 900–1700 □A. The exposure time was usually 30 to 35 minutes. The exposed samples were placed inside a Xerox Document 12/50 series printer for printing. The print target consists of a series of lines with the widths varying between about 1 bit to about 5 bits. How well a sample withstands against corona was determined by the visibility of those lines. A sample which prints no visible bit lines in the exposed area possesses no anti-deletion protection. The degree of anti-deletion protection of a sample was determined by the number of visible bit lines in the exposed area. Print Quality Image is defined as the number of visible bit lines in the exposed area. Table 1 sets forth the results of the testing of samples from the imaging members of Examples 1, 2 and 3 which were produced by machine coating.

TABLE 1

| Machine Coated Sample Prepared in accordance with: | % change Vresidual 10K cycles | % change E800-100 in 10K cycles | % change Dark Decay 10K cycles | Print Image Quality |
|---|---|---|---|---|
| Example 1 | −17.7 | 36.4 | −16.3 | 0 |
| Example 2 | 25.8 | 39.5 | 1.9 | 3 |
| Example 3 | 7.4 | 30.6 | −6.1 | 3 |

Although the invention has been described with reference to specific preferred embodiments, it is not intended to be limited thereto rather those skilled in the art will recognize that variations and modifications may be made therein which are within the spirit of the invention and within the scope of the claims.

We claim:

1. A dual charge transport layer having a top layer and a bottom layer, wherein the top layer and the bottom layer are adjacent to each other;

wherein the bottom layer is adjacent to a charge generation layer;

wherein the bottom layer comprises a first charge transport compound and a resin binder; and wherein the top layer comprises a second charge transport compound, said resin binder, and an oxidative inhibitor, wherein the oxidative inhibitor is pentaerythritol tetrakis[3,5-di-tert-butyl-4-hydroxyhydrocinnamate].

2. The dual charge transport layer of claim 1, wherein the first charge transport compound and the second charge transport compound are each an aromatic amine.

3. The dual charge transport layer of claim 2, wherein the first charge transport compound and the second charge transport compound are the same aromatic amine with the following formula:

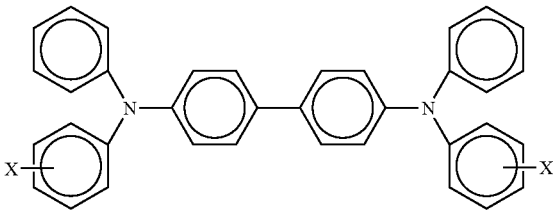

wherein X is a linear or branched alkyl with one to twelve carbon atoms.

4. The dual charge transport layer of claim 3, wherein X is a methyl in the meta or para position.

5. The dual charge transport layer of claim 1, wherein the thickness ratio of the top layer to the bottom layer is from about 10:1 to about 1:1.

6. A photoconductive imaging member comprising an electrically conductive substrate, a charge generation layer, and a dual charge transport layer having a top layer and a bottom layer wherein the top layer and the bottom layer are adjacent to each other;

wherein the bottom layer is adjacent to the charge generation layer;

wherein the bottom layer comprises a first charge transport compound and a resin binder; and wherein the top layer comprises a second charge transport compound, said resin binder, and an oxidative inhibitor, wherein the oxidative inhibitor is pentaerythritol tetrakis[3,5-di-tert-butyl-4-hydroxyhydrocinnamate].

7. The photoconductive imaging member of claim 6, wherein the first charge transport compound and the second charge transport compound are each an aromatic amine.

8. The photoconductive imaging member of claim 7, wherein the thickness ratio of the dual charge transport layer to the charge generation layer is from about 50:1 to about 100:1.

9. The photoconductive imaging member of claim 6, wherein the thickness ratio of the top layer to the bottom layer is from about 10:1 to about 1:1.

10. A process for the fabrication of a photoconductive imaging member comprising the steps of:

providing a substrate with a charge generation layer having an exposed surface; and depositing on the exposed surface of the charge generation layer a dual charge transport layer comprising a top layer and a bottom layer, by applying a first coating solution comprising a first charge transport compound and a resin binder to the exposed surface to form the bottom layer, and applying a second coating solution comprising pentaerythritol tetrakis[3,5-di-tert-butyl-4-hydroxyhydrocinnamate], a second charge transport compound and said resin binder to the exposed surface of the bottom layer to form the top layer of the dual charge transport layer.

11. The process of claim 10, wherein the first charge transport compound and the second charge transport compound are each an aromatic amine.

12. The process of claim 10, wherein the thickness ratio of the dual charge transport layer to the charge generation layer is from about 50:1 to about 100:1.

13. The process of claim 10, wherein the thickness ratio of the top layer to the bottom layer is from about 10:1 to about 1:1.

14. The photoconductive imaging member of claim 6, wherein the first charge transport compound and the second charge transport compound are the same aromatic amine.

15. The process of claim 10, wherein the first charge transport compound and the second charge transport compound are the same aromatic amine.

* * * * *